US011842650B2

(12) United States Patent
Pagodinas et al.

(10) Patent No.: US 11,842,650 B2
(45) Date of Patent: Dec. 12, 2023

(54) DEVICE AND METHOD FOR DETERMINING A SAFE AIRCRAFT RUNWAY DISTANCE

(71) Applicant: Kaunas University of Technology, Kaunas (LT)

(72) Inventors: Darijus Pagodinas, Kaunas (LT); Vytautas Dumbrava, Kaunas (LT)

(73) Assignee: Kaunas University of Technology, Kaunas (LT)

( * ) Notice: Subject to any disclaimer, the term of this patent is extended or adjusted under 35 U.S.C. 154(b) by 41 days.

(21) Appl. No.: 17/537,531

(22) Filed: Nov. 30, 2021

(65) Prior Publication Data

US 2022/0084419 A1 Mar. 17, 2022

Related U.S. Application Data

(63) Continuation-in-part of application No. 16/977,822, filed as application No. PCT/IB2019/050773 on Jan. 31, 2019, now abandoned.

(30) Foreign Application Priority Data

Mar. 5, 2018 (LT) ..... 2018509

(51) Int. Cl.
*G08G 5/00* (2006.01)
*G08G 5/06* (2006.01)

(52) U.S. Cl.
CPC ..... *G08G 5/0065* (2013.01); *G08G 5/0021* (2013.01); *G08G 5/065* (2013.01); *G08G 5/0091* (2013.01)

(58) Field of Classification Search
CPC .. G08G 5/0021; G08G 5/0065; G08G 5/0091; G08G 5/065
See application file for complete search history.

(56) References Cited

U.S. PATENT DOCUMENTS

| | | | | |
|---|---|---|---|---|
| 4,843,554 | A * | 6/1989 | Middleton | G05D 1/0083 701/15 |
| 9,245,450 | B1 * | 1/2016 | Chiew | G05D 1/0676 |
| 2008/0215198 | A1 * | 9/2008 | Richards | G08G 5/0021 701/408 |
| 2018/0089622 | A1 * | 3/2018 | Burch, V | B64U 50/19 |
| 2020/0145568 | A1 * | 5/2020 | Vollmerhausen | H04N 23/6812 |
| 2020/0216193 | A1 * | 7/2020 | Muehlbauer | G05D 1/0808 |

* cited by examiner

*Primary Examiner* — Omer S Khan
(74) *Attorney, Agent, or Firm* — Meunier Carlin & Curfman LLC

(57) ABSTRACT

The following teachings are of a portable autonomous device and method operating independently of aircraft flight control equipment. The device can be easily moved from one aircraft to another. The device measures the acceleration of the aircraft from the instantaneous speed and the runway distance covered from the start of the acceleration. Once the runway length and take-off speed is input, the device calculates the remaining distance to safely reach the take-off speed. If the remaining runway distance is not enough for the safe take-off, the device provides visual or audible information about the situation and signals to the pilot. In other embodiments, the determination and presentation of the remaining runway length may be implemented in the aircraft flight control equipment.

7 Claims, 5 Drawing Sheets

DEVICE AND METHOD FOR DETERMINING A SAFE AIRCRAFT RUNWAY DISTANCE

CROSS-REFERENCE TO RELATED APPLICATION

This patent application is a continuation-in-part of U.S. application Ser. No. 16/977,822, filed on Sep. 3, 2020. U.S. application Ser. No. 16/977,822 is a national stage application of the international application PCT/162019/050773, filed on Jan. 30, 2019. The international application, PCT/162019/050773, claims the benefit of an earlier filed foreign application, LT2018-509 filed Mar. 5, 2018. The above applications are incorporated by reference herein.

TECHNICAL FIELD

The invention relates to a method and device for determining aircraft runway safe distance and, in particular for determining the remaining, safe take-off runway distance without using built-in aircraft sensors.

BACKGROUND OF THE INVENTION

One of the major problems that aircraft pilots are facing at the time of takeoff is related to situation when an aircraft pilot cannot assess whether the runway is long enough for the aircraft to reach a required take-off speed. Depending on the size of an aircraft and its takeoff parameters, the required runway distance will vary. Known solutions for determining safe take-off distance include calculations of runway distance by built-in aircraft systems using built-in aircraft sensors or external systems to the built-in aircraft system, such as GPS.

The known solutions to the problem incorporate a combination of external sensor data and are intricately incorporated into an aircraft's cockpit. Both aircraft take-off and landing scenarios have some known solutions to alert the pilot of the degree of successful maneuvering using combinations of device and computer implemented logic considering the state of the aircraft and intended runway for take-off or landing. However, the solutions require complicated installation of a device, making it essentially non-transferrable to another aircraft, and the use of external sensors limits their compatibility with smaller aircrafts which do not have certain advanced sensor capabilities or aircrafts which may operate outside of, say, GPS signal area. Specifically, small recreational aircrafts which predominantly use shorter runways would greatly benefit from the use of a device and method for determining safe takeoff distance remaining on a runway that is both portable between aircrafts and which is autonomous, that is, no external sensors are necessary for operation.

The present invention provides a technical solution that is both portable and autonomous.

SUMMARY OF THE INVENTION

The invention is a method for determining remaining safe runway distance for take-off, independently of an aircraft flight control equipment, and a portable and autonomous device for implementing the method. The device can be easily moved from one aircraft to another. The device measures the acceleration of the aircraft then calculates instantaneous speed and runway distance from the start of acceleration without data input from aircraft flight control equipment. Once the runway length and required take-off speed are input, the device calculates the remaining distance required to safely reach the take-off speed. If the remaining runway distance is not enough for the safe take-off, the device provides visual or audible information about the situation to the pilot.

DETAILED DESCRIPTION OF THE INVENTION

The invention discloses a method for determining the current position of an aircraft with respect to a coordinate system, acceleration on a runway, and the method also determines whether the remaining runway length is enough for the aircraft to reach the required take-off speed.

Figure 1:
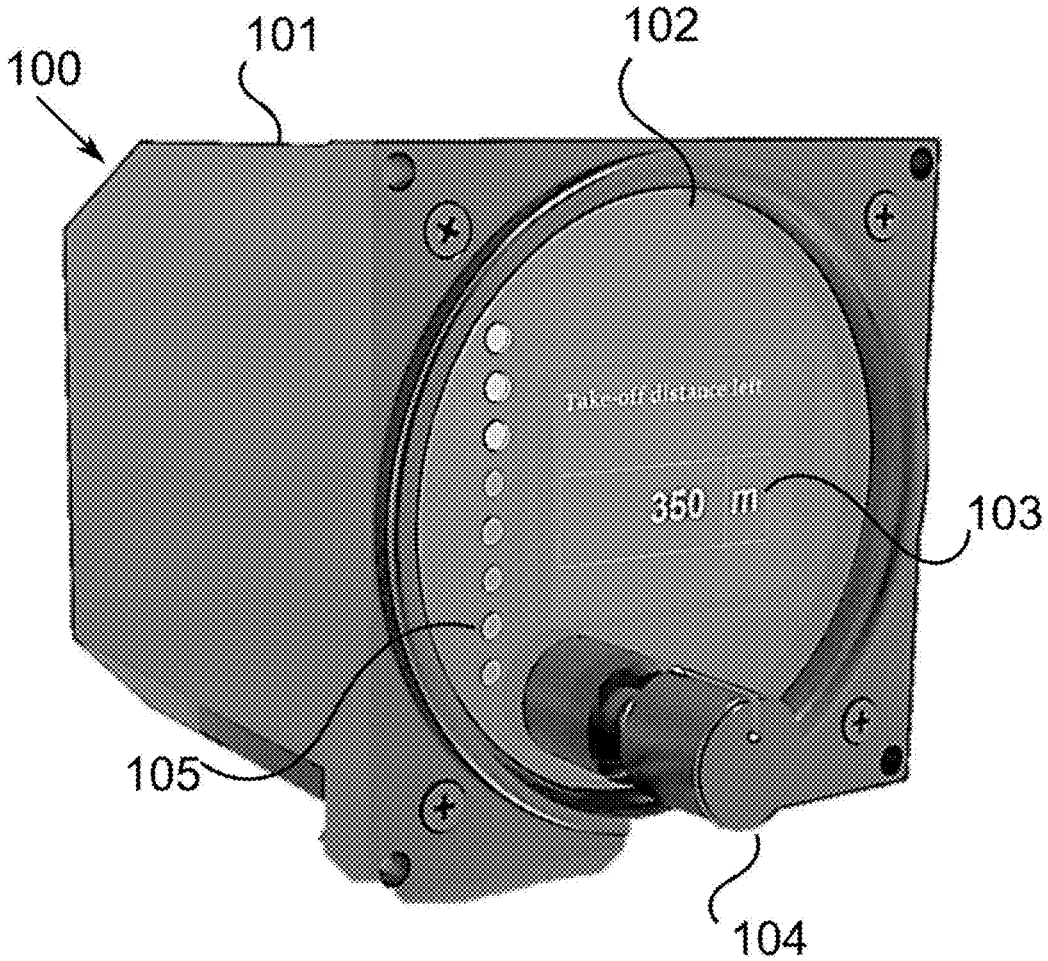
FIG. 1 is an image of the autonomous device.
Figure 2:
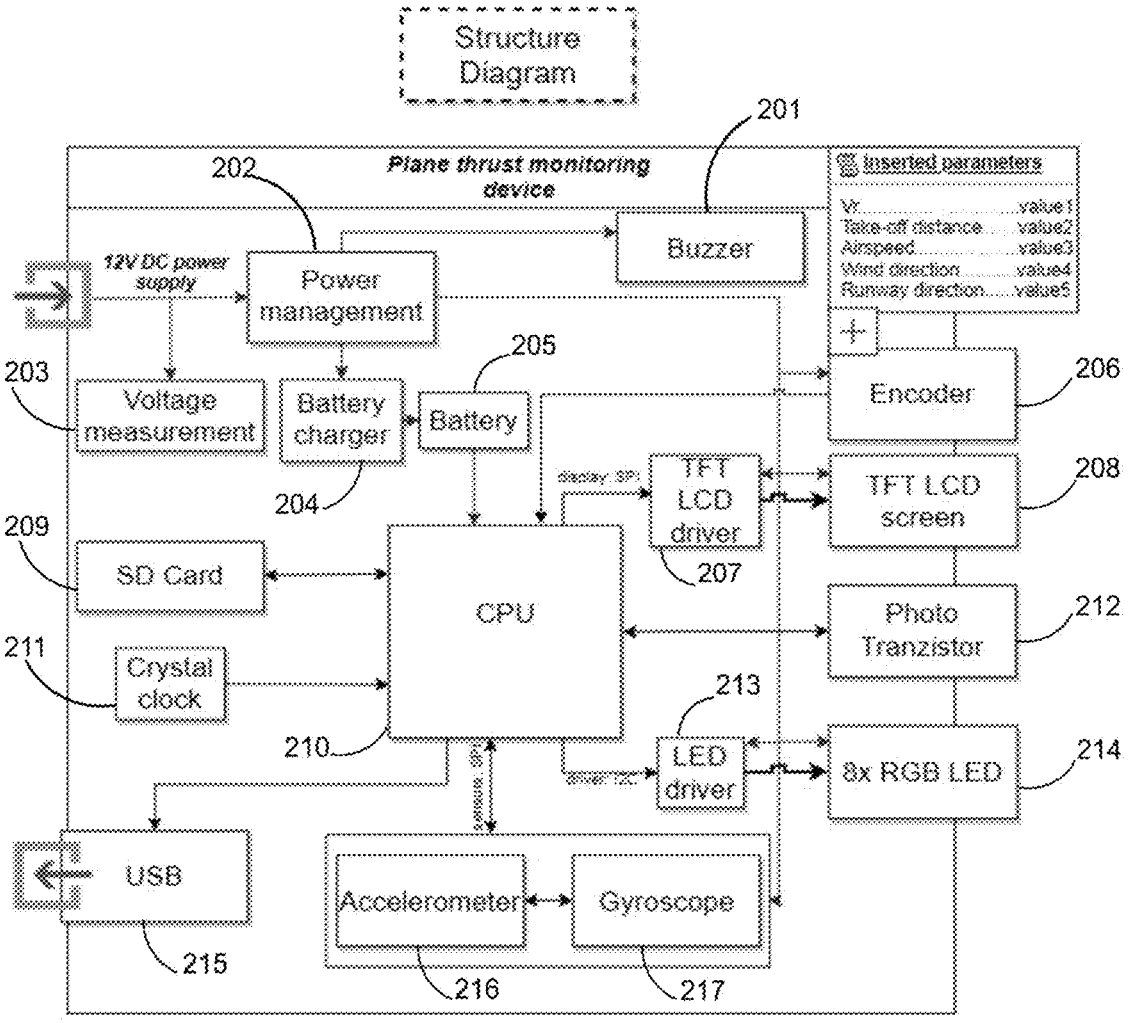
FIG. 2 is a schematic of internal components of the autonomous device.

The autonomous device (100), shown in FIG. 1, comprises a casing (1.0), where all components of the device (100) are assembled, a protective screen (102), for shielding information output area of the device (100), remaining safe runway distance data output area (103), a visual indicator (105), for warning of approaching end of safe distance for take-off, and a control knob (104) used for manual input entry. The internal componentry of the device (100) is shown in FIG. 2. Inside the casing (101) comprises a buzzer (201), for emitting an alarm sound for indicating the state of the safe for take-off distance, a 12V power supply, a power management unit (202), a voltage measurement unit (203), a battery (205), a battery charging unit (2.4), an encoder (206) which is integrated with the external control knob (104), a Thin-Film Transistor (TFT) LCD driver (207), a TFT LCD screen (208), an SD memory card reader unit (2.9), a Computer Processing Unit (CPU) (210), a crystal clock (211), a photo transistor (212), an LED driver (213), an RGB LED column (214), a data transfer connection port (215), such as USB port, an accelerometer (216) and a gyroscope (217).

The device (100) operates fully independently from any external conventional navigation systems used in aviation such as GPS, VOR, DME, NDB, ILS, MLS or other inner equipment of an aircraft. The encoder (206) is used for input of the input parameters. The input of the input parameters is done using the control knob (104) by rotating and pressing the knob (104). The TFT LCD screen (208) displays the input data at the time of entry and indicates the remaining runway length from the current runway reference to the last runway reference in relation to Take-Off Distance Available (TODA) or Take-Off Runway Available (TORA) when the device is initiated.

The accelerometer (216) and gyroscope (217) are used for automatic data acquisition in regular intervals, whereas manual data input (302) is required for initial input values of: runway length (TODA or TORA); take-off direction or "runway in use" (magnetic course in degrees) with respect to a coordinate system, i.e. World Countries or other coordinate system; meteorological wind direction (referred to as magnetic course in degrees) with respect to the coordinate system; wind speed (knots, or m/s); required take-off speed (Vr) or rotation speed of the aircraft (knots, or km/h). The device calculates the safe runway distance (506 and 510) based on input parameters and real-time data from accelerometer (216) and gyroscope (217) of the device (100).

The three-axis electronic accelerometer (216) is configured to measure instantaneous acceleration at regular intervals, while the electronic gyroscope (217) is configured to measure the instantaneous aircraft taxi angle with respect to the longitudinal axis in regular intervals. The electronic gyroscope (217) is necessary to calculate the actual distance traveled by the aircraft with respect to the longitudinal runway axis, which may not coincide with the distance traveled by derivation from the instantaneously measured acceleration of the aircraft. In order to perform such a conversion, it is necessary to measure the fluctuations of the aircraft taxi angle (instantaneous taxi angle with respect to the longitudinal axis) and to obtain a projection of the actual instantaneous velocity with respect to the longitudinal runway axis from the instantaneous taxi angle value using trigonometry (503).

The indicative column (214) of RGB LEDs provides the pilot with information about the current state of the aircraft's instantaneous speed, residual runway, and instantaneous acceleration with respect to the forecast to reach the aircraft's required take-off speed $V_r$ for the entire runway (TORA, TODA.). The LED column (214) can glow in three colors—green, yellow and red. If the aircraft achieves sufficient acceleration and velocity during the take-off runway and if its calculated predicted take-off run is in the range between 0-75%, the entire column (214) glows green. If the aircraft achieves an acceleration during the take-off runway sufficient to take-off between 76-99% of the runway length, the LED bar gradually changes color from green to yellow. If the estimated take-off distance for the runway is 99% of the TODA or TORA, the entire LED bar illuminates yellow, informing the pilot that the dangerous limit has been approached wherein the runway length may no longer be sufficient for safe take-off. If an acceleration and speed cannot be reached during the acceleration of the aircraft to ensures a safe take-off from 100 percent of the runway length, the entire LED bar immediately begins to glow red and an audible warning signal is generated. Both of the visual and audible warning signals are generated if the acceleration of the aircraft reaches zero or negative values along the take-off run.

The device (100) contains a computer processing unit (210) that is configured to perform a series of calculation, that together, comprise the steps of the method to continuously calculate a safe take-off distance (506) and continuously monitor the residual take-off distance (510), based on manual input parameters (302) combined with the real-time data obtained from the accelerometer (216) and gyroscope (217). The device also provides easy-to-understand visual and audio information to the pilot based on the results of the method to enable the pilot(s) to evaluate the objective situation of the residual take-off distance, instantaneous acceleration, and speed as well as aircraft position with respect to the runway length.

The method employs the measured instantaneous acceleration and gyroscopic data for determining the safe remaining take-off distance. The basis of the method steps is as follows:

The measured, instantaneous speed of the aircraft (ground speed) is converted to the to the ground speed with respect to the wind speed outside the aircraft (true air speed). The algorithm calculates the difference by adding (in case of head wind) or subtracting (in case of tail wind) the wind speed to/from the instantaneous speed (ground speed) of the aircraft.

The head wind or tail wind component, with respect to the aircraft, is calculated according to formula I:

$$V_{wind\ component}=V_{wind}\times\cos\alpha \quad \text{(I)}$$

wherein $V_{wind}$ is wind speed, $\alpha$ is the angle of direction of wind vector with respect to the aircraft. The angle, $\alpha$, is the difference between the aircraft take-off trajectory angle and the angle of wind direction. Unit degrees of both angles are with respect to magnetic direction, and both angles are manually input initial parameters (302).

Aircraft speed with respect to wind speed $V_{air}$, TAS (true air speed) is calculated (504) using formula II:

$$V_{air}=V_{ground}\pm V_{wind\ component} \quad \text{(II)}$$

wherein $V_{ground}$ is the instantaneous speed of the aircraft on the ground. $V_{ground}$ is obtained as a first derivative of the instantaneous acceleration of the aircraft. At the same time, from the same reference point, the second integral of instantaneous acceleration is evaluated to obtain the traveled distance of the aircraft. In this way, a single instance of instantaneous speed and distance value are obtained. Recalculation is performed every 250 ms. The TAS data is used to form an array which is used to extrapolate and determine whether the aircraft will reach the required take-off speed, $V_r$, in the remaining take off distance.

Figure 3:
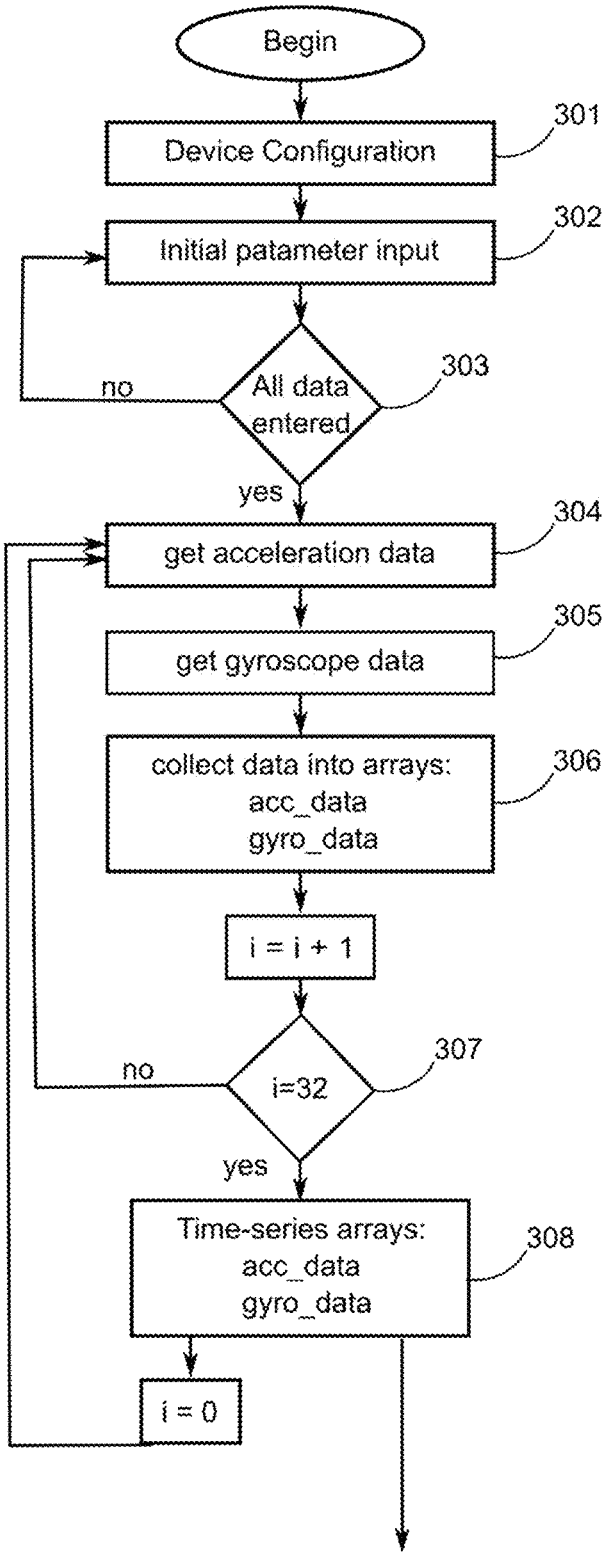
FIG. 3 is a flow-chart of the preferred embodiment of the method for data acquisition.
Figure 4:
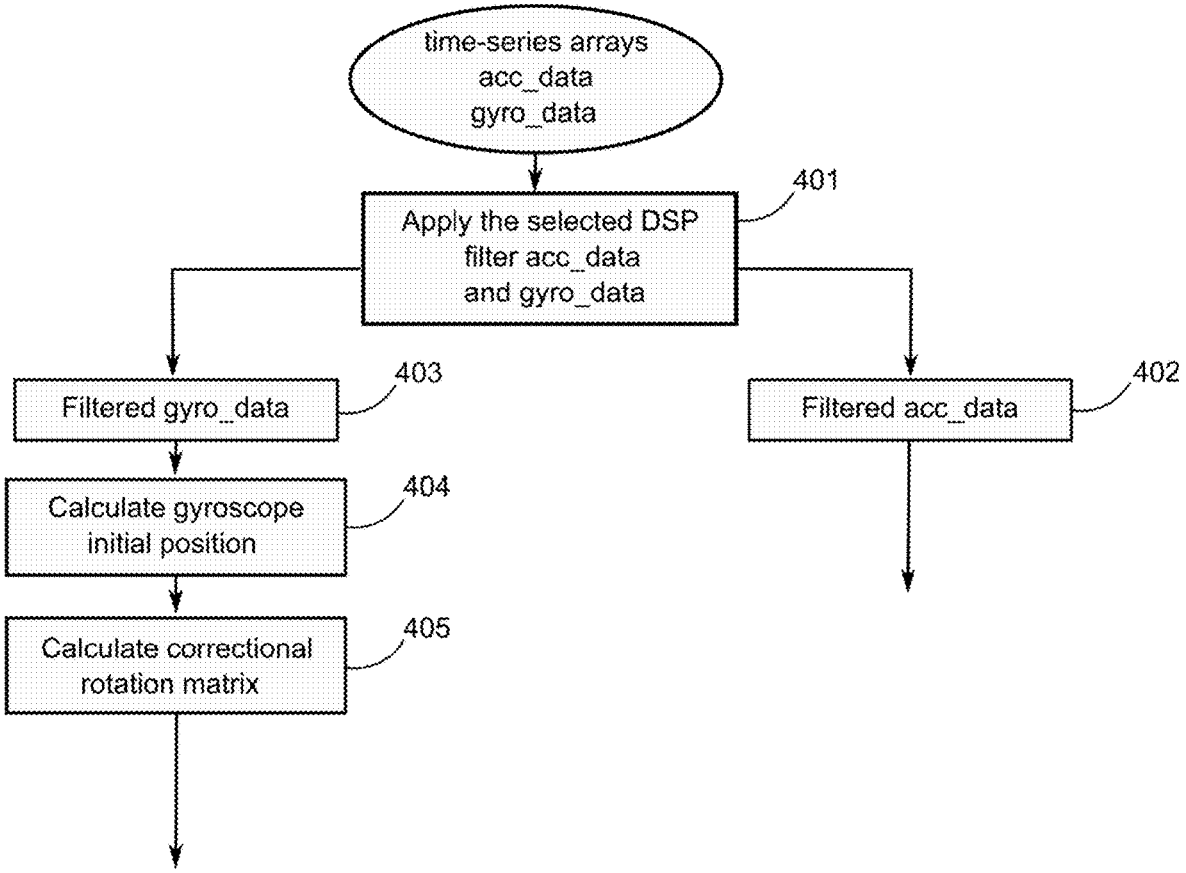
FIG. 4 is a flow-chart of the preferred embodiment of the method for data filtering.
Figure 5:
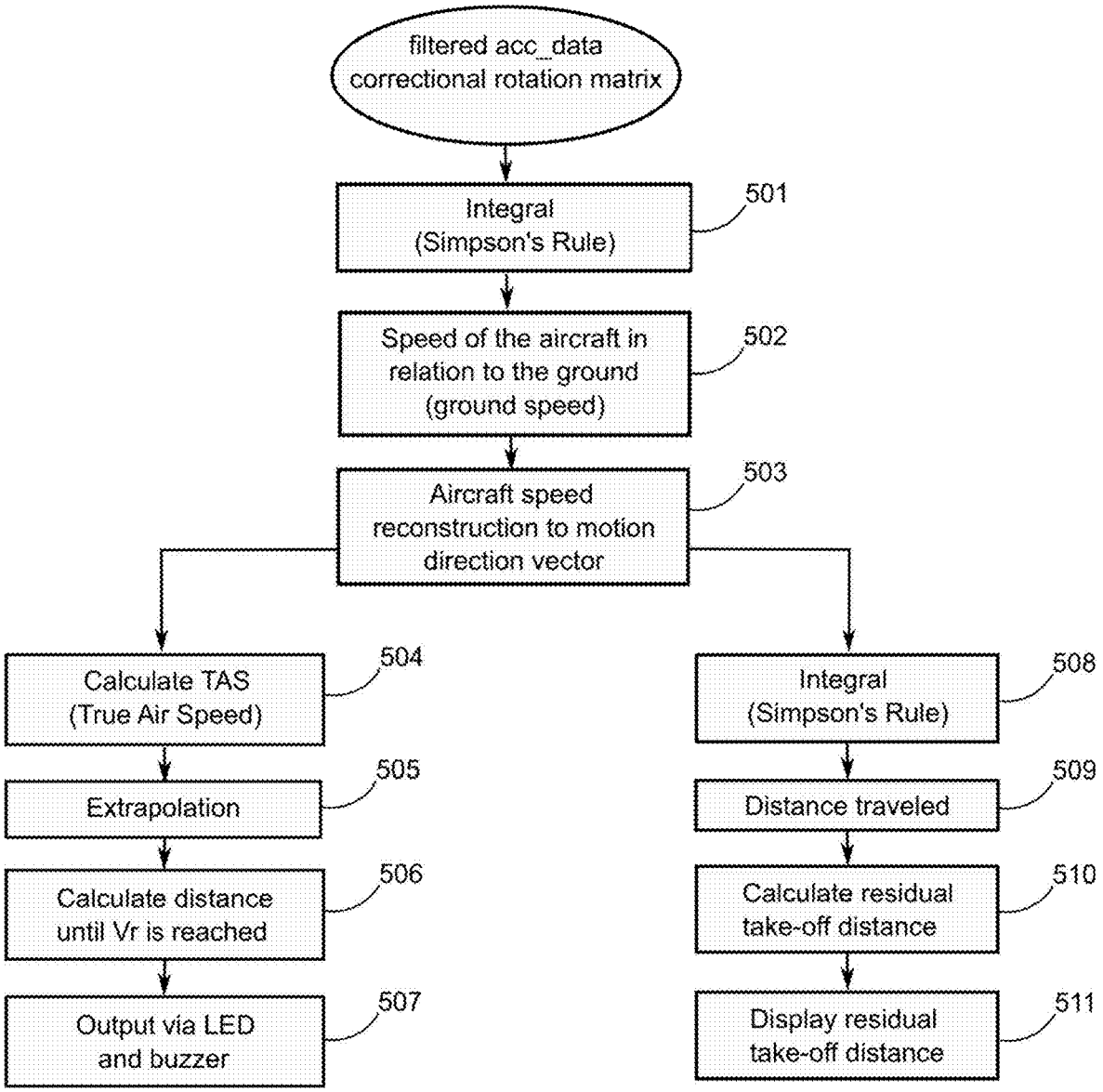
FIG. 5 is a flow-chart of the preferred embodiment of the method for data processing and output.

In the preferred embodiment of the method, shown in FIGS. 3-5, the following steps are performed on the CPU of the device, either encoded directly or encoded on software that is installed on the CPU. However, other combinations and order of operations are also within the scope of the method.

The first step of the method is to configure the device (301) for the user preferences including choice of units and threshold levels for the LED indicator (214). The next step is to input the initial parameters (302) using the control knob (104). Once the initial setup steps are accomplished, the accelerometer and gyroscope will begin recording aircraft data once the acceleration of the aircraft exceeds 0.0 km/s$^2$ (304 and 305).

The accelerometer (216) and gyroscope (217) continuously record aircraft data at regular intervals (306), and after a set number of data entry points are collected into data arrays (307), the time series of acceleration and gyroscopic data are sent (508) to a set of one or more digital signal processing filters to remove plane engine noise from the accelerometer and gyroscope measurements (401). The set number of data points collected before calculations begin (307) should be chosen based on the capabilities of the device processing units—a small enough number that the data can be processed efficiently, without significant delay—and based on the sampling frequency of the accelerometer and gyroscope. In the preferred embodiment, thirty-two, 32, measurements are collected before processing.

In order to calculate aircraft speed and traveled distance accelerometer measured linear acceleration is used. However, the accelerometer measures linear and stationary acceleration, so Earth's gravitational force needs to be compensated from the measured acceleration values. Because the device can be installed in aircraft at any angle, the gravitational component to acceleration may be present in more than one acceleration axis. Compensation of gravitational acceleration (405) includes calculating roll/pitch angles using initial acceleration angles after the user inputs all parameters for flight and confirms it. Then a rotation matrix is calculated. While waiting for initial take-off this matrix is not updated, raw accelerometer values are rotated using this matrix where the x-axis represents the moving trajectory, the z-axis contains the vector relating to gravitational acceleration. After the take-off start is detected, gyroscopic measurements are taken into account. Together with the raw accelerometer values, gyroscope measured rotations are integrated using a Mahony filter to calculate current roll/pitch/yaw. If roll or pitch deviates from initial calculated by 3°, then rotation matrix is updated by new values.

Instantaneous speed of the aircraft is calculated as a first integral of acceleration with respect to time (501) by applying Simpson's rule and using the bias-filtered acceleration data array. The resulting, instantaneous speed is equivalent to the ground speed of the aircraft (502), hereafter referred to as ground speed. The ground speed direction is further corrected using the calculated rotation matrix to compute the ground speed direction along the longitudinal axis of the runway (503).

The directionally aligned ground speed of the aircraft is used to compute two different estimates of the safe runway distance remaining. First, the instantaneous position of the aircraft with respect to the length of the runway is determined using a second integral (508) of acceleration with respect to time, similarly encoded using Simpson's rule. The result of integration (508) is the distance traveled (509) and the distance traveled is next used to determine the residual take-off distance from the TODA or TORA, initially input before take-off (510). The residual take-off distance is then displayed on the TFT LCD screen (511).

The second computation using the directionally aligned ground speed of the aircraft is the computation of the true air speed (3.28). A best-fit regression is applied to the array of TAS using algorithm (504), wherein the best-fit regression equation is used to extrapolate (505) the position along the runway when the required take-off speed, Vr, is reached and the corresponding position of the residual runway length (506). In the preferred embodiment, polynomial regression is used.

All the instantaneous values of the measured acceleration (304) and calculated instantaneous values of speed and aircraft position with respect of length of the runway are stored in the SD memory card (209) of the device (100), where the device (100) stores data for up to 40 seconds, which fully complies with the maximum required acceleration time period while an airplane is on the runway. A prediction of the position along the runway once the aircraft achieves the required take-off speed, Vr, is given at least 10 seconds after acceleration starts.

Visual and audible (507) pilot information signals are generated based on the residual distance of the runway from the take-off point of the aircraft to the end of the runway. If the predicted take-off speed (Vr) is achievable in the runway range from 0-75% of the input TOGA or TORA, the entire visual indicator (105) on the instrument panel is green. If the predicted take-off speed (Vr) is reached in the range of 76 to 99%, the visual indicator (105) illuminates partially green, partially yellow, depending on which part of the interval the predicted take-off speed (Vr) value is at. When the predicted Vr is reached at 100% or more of the relative runway length, the entire indicator (105) illuminates red and a pilot warning signal is generated at the same time. The indicator threshold parameters can be changed by the user, using the control knob (104), adapting them to the specific conditions of the aerodrome and the aircraft itself.

In order to provide the most accurate information on the position of the aircraft on the runway, said calculations of the position are carried out continuously, re-evaluating the instantaneous acceleration, instantaneous speed with respect to air, the position on the runway, remaining runway distance to achieve the required take-off speed every 250 ms.

Terms "the first acceleration integral with respect to time" and "the second acceleration integral with respect to time" are general terms having a well-known meaning in the art of calculating speed and traveled distance of moving objects.

The described device and method are useful and convenient in that when measuring the actual instantaneous speed, a number of factors that determine the acceleration of the aircraft (e. g. the nature of the runway pavement, the hardness of the pavement, some of the described embodiments evaluate environmental conditions (wind influence, etc.) are evaluated.

The embodiments, as understood by those skilled in the art, may be modified without deviating from the scope of this invention.

The invention claimed is:

1. A device for determining a safe runway distance during aircraft take-off, the device configured to be positioned on the aircraft during operation and to operate independently from onboard flight control equipment of the aircraft, the device comprising:

an accelerometer;

a gyroscope;

a control knob for receiving user inputs;

at least one display screen;

a device for emitting sound;

at least one processor; and memory having instruction stored thereon that, when executed by the at least one processor, cause the device to:

receive, via the control knob, a user input indicating a runway length, a take-off direction with respect to a coordinate system, a wind direction with respect to the coordinate system, a wind speed, and a required take-off speed of the aircraft;

periodically measure: (i) an acceleration of the aircraft using the accelerometer, and (ii) an aircraft taxi angle of the aircraft using the gyroscope;

compensate for gravitational acceleration with respect to the measurements of the acceleration of the aircraft by: (i) calculating roll and pitch angles from initial values measured by at least one of the accelerometer or the gyroscope, (ii) calculating a rotation matrix from the roll and pitch angles, (iii) using the rotation matrix to rotate raw measurements from the accelerometer, wherein an x-axis represents a moving trajectory and a z-axis contains a vector relating to gravitational acceleration, (iv) calculate current roll, pitch, and yaw by integrating the raw measurements from the accelerometer with rotations measured by the gyroscope, and (v) update the rotation matrix if the roll or the pitch deviates from an initial value by a threshold amount;

periodically calculate a ground speed of the aircraft by evaluating a first integral of a most recently measured value of the acceleration of the aircraft with respect to time;

determine a distance traveled by the aircraft on the runway by evaluating a second integral of the most recently measured value of the acceleration with respect to time;

determine a remaining runway distance based on the distance traveled by the aircraft and the runway length;

present an indication of the remaining runway distance on the at least one display screen;

generate an array of air speed values by calculating, for each periodic calculation of the ground speed, an air speed value of the aircraft, wherein the air speed value is defined as the ground speed of the aircraft with respect to the wind speed, wherein: (i) the wind speed is added to the ground speed in the case of a head wind, as determined by the wind direction, or (ii) the wind speed is subtracted from the ground speed in the case of a tail wind, as determined by the wind direction;

predict a position of the aircraft along the runway when an air speed of the aircraft equals the required take-off speed by extrapolating the array of air speed values;

calculate a percentage of remaining runway distance at the predicted position of the aircraft along the runway with respect to the runway length; and provide an indication of whether the remaining runway distance is safe based on the calculated percentage of remaining runway distance via the at least one display screen or the device for emitting sound, wherein providing the indication via the device for emitting sound comprises emitting an audible alarm if it determined that the remaining runway distance is not safe based on the calculated percentage of remaining runway distance.

2. The device of claim 1, further comprising a casing that encloses the accelerometer, the gyroscope, the at least one processor, the memory, and that at least partially encloses the control knob, the at least one display screen, and the device for emitting sound, such that that the device is portable and independent from on-board flight equipment of the aircraft.

3. The device of claim 1, wherein the ground speed is calculated every 250 milliseconds.

4. The device of claim 1, wherein the instructions further cause the device to:

store acceleration and aircraft taxi angle data for each periodic measurement; and filter the acceleration and aircraft taxi angle data using one or more digital filters to remove aircraft engine noise prior to periodically calculating the ground speed or determining the distance traveled by the aircraft on the runway.

5. The device of claim 1, wherein the threshold amount is 3°.

6. The device of claim 1, wherein at least one of the first integral or the second integral are evaluated using Simpson's rule.

7. The device of claim 1, wherein the array of air speed values is extrapolated using polynomial regression.

* * * * *